United States Patent [19]

Smith et al.

[11] Patent Number: 5,024,777

[45] Date of Patent: Jun. 18, 1991

[54] SYNERGISTIC LIME SOAP DISPERSING COMPOSITION

[75] Inventors: Kim R. Smith; James E. Borland, both of Baton Rouge, La.

[73] Assignee: Ethyl Corporation, Richmond, Va.

[21] Appl. No.: 468,763

[22] Filed: Jan. 23, 1990

[51] Int. Cl.[5] ..... C11D 9/30; C11D 9/00

[52] U.S. Cl. ..... 252/117; 252/108; 252/541; 252/544; 252/DIG. 5; 252/DIG. 6; 252/DIG. 16

[58] Field of Search ..... 252/DIG. 16, 117, 134, 252/121

[56] References Cited

U.S. PATENT DOCUMENTS

| | | | |
|---|---|---|---|
| 4,026,825 | 5/1977 | Steen | 252/155 |
| 4,812,253 | 3/1989 | Small | 252/DIG. 16 |
| 4,919,838 | 4/1990 | Tibbetts | 252/DIG. 16 |

*Primary Examiner*—Paul Lieberman
*Assistant Examiner*—Kevin McCarthy
*Attorney, Agent, or Firm*—Joseph D. Odenweller; Patricia J. Hogan

[57] ABSTRACT

A bar soap composition which contains 5–95 weight percent of a fatty acid soap and a $C_{8-20}$ alkyl dimethylamine oxide and sodium cocoyl isethionate in a weight ratio of 0.33–3.0:1.0 which results in synergistic improvement in the lime soap dispersancy of the composition.

8 Claims, No Drawings

SYNERGISTIC LIME SOAP DISPERSING COMPOSITION

BACKGROUND

Sodium cocoyl isethionate is a known surfactant. Its main use has been in formulating personal hygiene detergent bars. Long chain alkyl dimethylamine oxides are also known surfactants having excellent foaming properties. Their use in formulating toilet soap bars has been limited by the fact that they have only been available as aqueous solutions containing about 30 weight percent of the active alkyl dimethylamine oxide. When used to prepare toilet soap, this leads to an excessive amount of water which must be removed. Heating to evaporate this water can lead to decomposition of the amine oxide which is not thermally stable at temperatures much over 100° C. At lower temperatures under vacuum, frothing presents a problem.

Recently a practical method of making long chain alkyl dimethylamine oxide dihydrates has been discovered. This process is described in U.S. patent application Ser. No. 344,275, filed Apr. 26, 1989. This discovery has made it practical to include alkyl dimethylamine oxides in toilet detergent bar formulations.

Lime soap dispersancy is the ability of a detergent to prevent deposition of insoluble lime soap when a fatty acid soap-containing composition is dissolved in water containing calcium and/or magnesium cations. Such deposits lead to the scum frequently seen in sinks and bath tubs. A need exists for a soap composition that resists such formations.

SUMMARY

It has now been discovered that soap compositions which contain both sodium cocoyl isethionate and long chain alkyl dimethylamine oxides in the weight ratio of 1:3 to 3:1 exhibit a synergistic suppression of the amount of lime soap deposits in hard water.

DESCRIPTION OF THE PREFERRED EMBODIMENTS

A preferred embodiment of this invention is a detergent composition having superior lime soap dispersing properties, said composition containing 5–95 weight percent of a fatty acid soap and a $C_{8-20}$ alkyl dimethylamine oxide and sodium cocoyl isethionate in a synergistic weight ratio of 0.33–3.0 parts $C_{8-20}$ alkyl dimethylamine oxide per part of sodium cocoyl isethionate.

Examples of useful $C_{8-20}$ alkyl dimethylamine oxides are:

octyl dimethylamine oxide
2-ethylhexyl dimethylamine oxide
2-ethyloctyl dimethylamine oxide
decyl dimethylamine oxide
2-ethyldecyl dimethylamine oxide
tetradecyl dimethylamine oxide
hexadecyl dimethylamine oxide
octadecyl dimethylamine oxide
eicosyl dimethylamine oxide The preferred $C_{8-20}$ alkyl dimethylamine oxides are those in which the $C_{8-20}$ alkyl groups is a mainly straight chain group. Some branching can be accepted but the alkyl groups should be at least 75 percent straight chain and more preferably at least 90 percent straight chain.

The more highly preferred alkyl dimethylamine oxides are the mainly straight chain $C_{12-18}$ alkyl dimethylamine oxides such as n-tetradecyl dimethyl amine oxide and n-hexadecyl dimethylamine oxide.

The preferred method of introducing the $C_{8-20}$ alkyl dimethylamine oxide into the detergent composition is in the form of a dihydrate. This avoids the excessive amount of water encountered in use of aqueous solutions of alkyl dimethylamine oxides such as the commercially available 30 weight percent solutions.

The essential trialkylamine oxide dihydrates can be made by the process described in application Ser. No. 344,275, filed Apr. 26, 1989. According to that process, the appropriate amine is reacted with at least a stoichiometric amount of concentrated (e.g., 50–70 weight percent active) hydrogen peroxide in an organic ester solvent (e.g., ethyl acetate) in an amount sufficient to maintain a fluid reaction mixture. Reaction temperatures of about 25–100° C. can be used. A preferred range is 60–75° C. Carbon dioxide can be injected to promote the reaction. Use of about 1.2 theories of 70 weight percent hydrogen peroxide results in a final reaction mixture which contains about 2 moles of water per mole of amine oxide. If more water than this is present, it should be distilled out to obtain a 2/1 water/amine oxide mole ratio. The organic ester solution can then be cooled causing the amine oxide dihydrate to crystallize. Alternatively, the organic ester can be distilled out at atmospheric pressure or under vacuum to obtain the amine oxide dihydrate as the residue. It was surprisingly found that the tert-amine oxide dihydrate was not hygroscopic.

The following Examples show how to make the required trialkylamine oxide dihydrate.

EXAMPLE 1

In a 250 milliliter glass reaction flask was placed 100 grams of tetradecyldimethylamine (0.41 mole; amine value 230.0 mg KOH/g amine) and 0.5 gram (1.27 mmol) of diethylenetriaminepentaacetic acid. This was heated with stirring to 65° C. and then 23 grams (0.47 mole) of 70 weight percent aqueous hydrogen peroxide was added dropwise over a 15-minute period. The mixture was then heated to 76° C. and stirred at that temperature for seven hours. As needed, ethyl acetate (34 mL) was added dropwise to the reaction mass in order to maintain a clear, gel-free liquid. Analysis of the crude reaction mass by proton NMR showed 99 percent amine conversion. The crude reaction mass was added to 400 mL additional ethyl acetate. The solution was then cooled to 15° C. forming a non-hygroscopic white crystalline solid tetradecyldimethylamine oxide dihydrate melting at about 41° C. in 86% recovered yield.

EXAMPLE 2

In a glass reaction flask was placed 100 g tetradecyl dimethylamine and 0.5 g diethylenetriamine pentaacetic acid. Carbon dioxide sparge into the liquid phase was started and the mixture was stirred and heated to 65° C. The $CO_2$ sparge was stopped and a $CO_2$ gas phase was maintained over the reaction mixture. Dropwise feed of 70 weight percent aqueous hydrogen peroxide was started. At the same time, addition of ethyl acetate was commenced. After 10 minutes all the hydrogen peroxide and 28 mL of ethyl acetate had been added. Cooling was required to maintain the temperature under 75° C. Heat was applied and the reaction continued for two more hours. Dropwise addition of ethyl acetate was continued for the first 19 minutes of the two-hour period. Total ethyl acetate feed was 43 mL. The reaction mixture was a clear gel-free solution. The reaction mixture was analyzed by NMR showing a 100 percent amine conversion. The reaction mixture was poured into a flask containing 300 mL of ethyl acetate and cooled to 15° C. Needle-like crystals of tetradecyl dimethylamine oxide dihydrate formed (106 g) indicating a 87 percent yield.

The weight ratio of the $C_{8-20}$ alkyl dimethylamine oxide to sodium cocoyl isethionate is critical. Both alkyl dimethylamine oxides and sodium cocoyl isethionate are capable of some lime soap dispersancy. However, when combined in the proper ratio, the lime soap dispersancy of the mixture is superior to that of an equal amount of either component. The critical range is 0.33–3.0 parts by weight $C_{8-20}$ alkyl dimethylamine oxide per part sodium cocoyl isethionate. A more preferred range is 0.66–1.5 parts of $C_{8-20}$ alkyl dimethylamine oxide per part sodium cocoyl isethionate and most preferably about 1 to 1.

The amount of $C_{8-20}$ alkyl dimethylamine oxide in this composition is about 1–40 weight percent. A preferred range is about 5–25 weight percent.

The amount of sodium cocoyl isethionate is in the range of 1–40 weight percent and preferably 5–25 weight percent.

Other components can optionally be included in the detergent bar formulation. These include titanium dioxide, glycerol or other polyol moisturizers, fragrance, bactericide, fungicide, dye, fatty acids (e.g., stearic acid), polyglycols, alkanol amines (e.g., triethanol amines), witch hazel, citric acid, opalescent agents, opacity agents, water, and the like.

Other synthetic detergents may be used in combination with the present trialkylamine oxide dihydrates. These include sodium cocoyl n-methyl tauride, sodium oleylsulfate, sodium monolauryl sulfosuccinate, sodium salt of mono-oleic acid ester of glycerol sulfate, sodium lauryl sulfoacetate, sodium isostearoyl-2-lactylate, lauryl diethanolamide, and the like.

The amount of synthetic detergent other than the trialkylamine oxide dihydrate and sodium cocoyl isethionate in the toilet bar can vary widely from none to about 80 weight percent. A useful range is about 10–75 weight percent.

The trialkylamine oxide dihydrate can be mixed with the other ingredients in the detergent bar formulation by any of the known procedures. After the trialkylamine oxide dihydrate is blended into the formulation, the mixture should not be heated over about 120° C. and preferably not over 100° C. The trialkylamine oxide decomposes at elevated temperatures.

A useful method to prepare the formulation is to pre-mix all ingredients that require drying such as the wet soap noodles and to heat this pre-mixture to drive off water to the desired water content (ca 10%). The dehydrated mixture is then fed to a 3-roll mill together with the trialkylamine oxide dihydrate and any other ingredients desired and the mixture is thoroughly blended. The blended mixture is extruded in a plodder to form an elongated log. The elongated log is cut into soap bar size segments and each segment is placed in a two-piece mold which is compressed to form the final detergent bar.

The trialkylamine oxide dihydrates may be added as a liquid or as a solid. The low carbon number dihydrates are liquids under ambient conditions. For example, octyl dimethylamine oxide dihydrate melts at about 15° C. Decyl dimethylamine oxide dihydrate melts at 22–23° C. The more preferred $C_{12}$ and higher alkyl dimethylamine oxide dihydrates melt above 30° C. For example, n-dodecyl dimethylamine oxide dihydrate melts at 30–31° C., tetradecyl dimethylamine oxide dihydrate melts at 41–42° C., hexadecyl dimethylamine oxide dihydrate melts at 49–50° C. and octadecyl dimethylamine oxide dihydrate melts at 61–62° C.

The detergent compositions contain a fatty acid soap such as an alkali metal or ammonium salt of a $C_{12-20}$ fatty acid or mixture thereof. Examples of these are the fatty acid soaps of tallow acid, oleic acid, stearic acid, coco acid and the like. Neutralizing agents include alkali metal hydroxides and tert-amines such as triethanol amine, coco diethanol amine, and the like. A very useful fatty acid is a 80/20 mixture of tallow/coco fatty acids. Preferred soaps are the sodium soaps.

The amount of soap in these compositions is about 5–95 weight percent, more preferably, 10–90 weight percent. A most preferred range is about 25–75 weight percent soap.

Lime soap dispersancy is the ability to prevent deposition of insoluble lime soaps which form when fatty acid soaps are added to hard water. For example, addition of a soap-containing sodium stearate to water containing calcium cations forms calcium stearate which is insoluble and forms an unsightly scum in sinks and bath tubs. The following method was used for a comparison of the lime soap dispersing efficiency different detergent compositions. A known amount of dispersing agent was added to 10 mL portion of one percent Ca stearate slurry. This sample and a control without dispersant were then shaken in test tubes and compared for complete dispersion of the calcium stearate after standing 2 minutes. The reported results reflect the grams of dispersants required to fully disperse 100 g of calcium stearate.

| | Component Ratio[1] in the Dispersant | | | | |
|---|---|---|---|---|---|
| | 1:0 | 3:1 | 1:1 | 1:3 | 0:1 |
| Dispersant Required (g) | 16 | 13 | 8 | 11.5 | 41 |

[1]Ratio of n-tetradecyl dimethylamine oxide to sodium cocoyl isethionate

The test results clearly show the synergistic effect of a combination of alkyl dimethylamine oxide and sodium cocoyl isethionate in dispersing a typical lime soap in ratios between 3:1 and 1:3. In the absence of alkyl dimethylamine oxide, sodium cocoyl isethionate had very poor lime soap dispersing properties requiring 41 grams to disperse 100 grams of lime soap. By itself, n-tetradecyl dimethylamine oxide required 16 grams to disperse 100 grams of lime soap. It was surprising to discover that replacing part of the alkyl dimethylamine oxide with the poor lime soap dispersant, sodium cocoyl isethionate, instead of diminishing its lime soap dispersing properties, actually sharply increased the lime soap dispersant effect.

We claim:

1. A bar soap composition having superior lime soap dispersing properties, said composition containing 5–95 weight percent of a fatty acid soap 1 to 40 wt. % of each of and a $C_{8-20}$ alkyl dimethylamine oxide and sodium cocoyl isethionate in a synergistic weight ratio of 0.33–3.0 parts $C_{8-20}$ alkyl dimethylamine oxide per part of sodium cocoyl isethionate.

2. A bar soap composition of claim 1 wherein said $C_{8-20}$ alkyl dimethylamine oxide is a mainly straight chain $C_{12-18}$ primary alkyl dimethylamine oxide, and a fatty acid soap.

3. A bar soap composition of claim 2 wherein said $C_{12-18}$ alkyl dimethyulamine oxide is n-tetradecyl dimethylamine oxide.

4. A bar soap composition of claim 1 containing about 1–25 weight percent $C_{8-20}$ alkyl dimethylamine oxide and 1–25 weight percent sodium cocoyl isethionate.

5. A bar soap composition of claim 4 wherein said $C_{8-20}$ alkyl dimethylamine oxide is a inlay straight chain primary $C_{12-18}$ alkyl dimethylamine oxide.

6. A bar soap composition of claim 5 wherein said $C_{12-18}$ alkyl dimethylamine oxide is n-tetradecyl dimethylamine oxide.

7. A bar soap composition of claim 3 which includes about 10–90 weight percent of a fatty acid soap.

8. A bar soap composition of claim 7 containing 5–25 weight percent $C_{12-18}$ alkyl dimethylamien oxide and 5–25 weight percent of sodium cocoyl isethionate.

* * * * *

UNITED STATES PATENT AND TRADEMARK OFFICE

CERTIFICATE OF CORRECTION

PATENT NO. : 5,024,777

DATED : June 18, 1991

INVENTOR(S) : Kim R. Smith et al.

It is certified that error appears in the above-identified patent and that said Letters Patent is hereby corrected as shown below:

Column 4, line 64, reads "soap 1 to 40 wt. %" should read --soap and 1 to 40 weight percent--.

Column 4, line 65, reads "of and a $C_{8-20}$" and should read -- of a $C_{8-20}$ --.

Column 6, line 2, reads "is a inlay straight chain" and should read -- is a mainly straight chain --.

Column 6, line 10, reads "dimethylamien" and should read -- dimethylamine --.

Signed and Sealed this

Thirtieth Day of March, 1993

*Attest:*

STEPHEN G. KUNIN

*Attesting Officer*

*Acting Commissioner of Patents and Trademarks*